US006164814A

United States Patent [19]

Crow

[11] Patent Number: 6,164,814

[45] Date of Patent: Dec. 26, 2000

[54] WATCH HAVING ROTATABLE BEZEL

[76] Inventor: Milton E. Crow, 1308 Sherwood, Baytown, Tex. 77520

[21] Appl. No.: 09/139,035

[22] Filed: Aug. 24, 1998

[51] Int. Cl.[7] ..... G04B 37/00; G04B 39/00

[52] U.S. Cl. ..... 368/276; 368/295; 368/301

[58] Field of Search ..... 368/88, 74, 80, 368/223, 228, 276–278, 294–300, 309, 346, 350, 353

[56] References Cited

U.S. PATENT DOCUMENTS 1,382,256 6/1921 Tomchin .
3,271,945 9/1966 Anderson ..... 368/295
3,505,808 4/1970 Eschle ..... 368/295
3,553,958 1/1971 Grohoski ..... 368/294
3,757,513 9/1973 Tokunaga ..... 368/294
4,976,548 12/1990 Tschanz ..... 368/277
5,828,541 10/1998 Wu ..... 368/278

*Primary Examiner*—Vit Miska
*Attorney, Agent, or Firm*—Gerard F. Dunne

[57] ABSTRACT

A watch suitable for use in outdoor activities includes a casing holding the workings of the watch which includes a watch face. A clear facing for viewing the watch is held to the casing, and a bezel held rotatably to the casing carries an integral fob for securing the watch to the user. In this way, the watch casing may be rotated by the user to orient the watch face for viewing.

6 Claims, 1 Drawing Sheet

WATCH HAVING ROTATABLE BEZEL

FIELD OF THE INVENTION

The invention relates to watches, particularly pocket watches for use in outdoor activities.

BACKGROUND OF THE INVENTION

As the populace becomes more engaged in outdoor sporting activities, such as mountaineering, rock climbing and other vigorous outdoor activities, needs have developed for a rugged watch to be used by such outdoor enthusiasts. A watch of the present invention is designed to be of a style of a pocket watch which can be suspended from a lanyard around the neck or secured to the clothing or other equipment of the user; and includes a rotatable bezel so the face of the watch can be positioned for traditional viewing regardless of the orientation of the user.

To this end, a watch of the present invention is adapted for use in outdoor activities and includes a casing holding the workings of the watch. The watch workings include a watch face, and a clear facing for viewing the watch face is held to the casing. A bezel is held rotatably to the casing and carries a integral fob for securing the watch to the user. In this way, the watch casing may be rotated by the user to orient the watch face for viewing.

In a preferred form of the invention, the bezel may be rotated in one direction only and includes markings adapted to indicate a particular minute indicated on the watch face so as to represent elapsed time from the positioning of the markings by the user.

These and other objects, features and advantages of the present invention will become more apparent upon review of the detailed descriptions made below of a preferred embodiment, said descriptions being made in conjunction with the drawing figure.

FIG. 1 is a perspective view of a watch according to the present invention.

DETAILED DESCRIPTION OF PREFERRED EMBODIMENT

Figure 1:
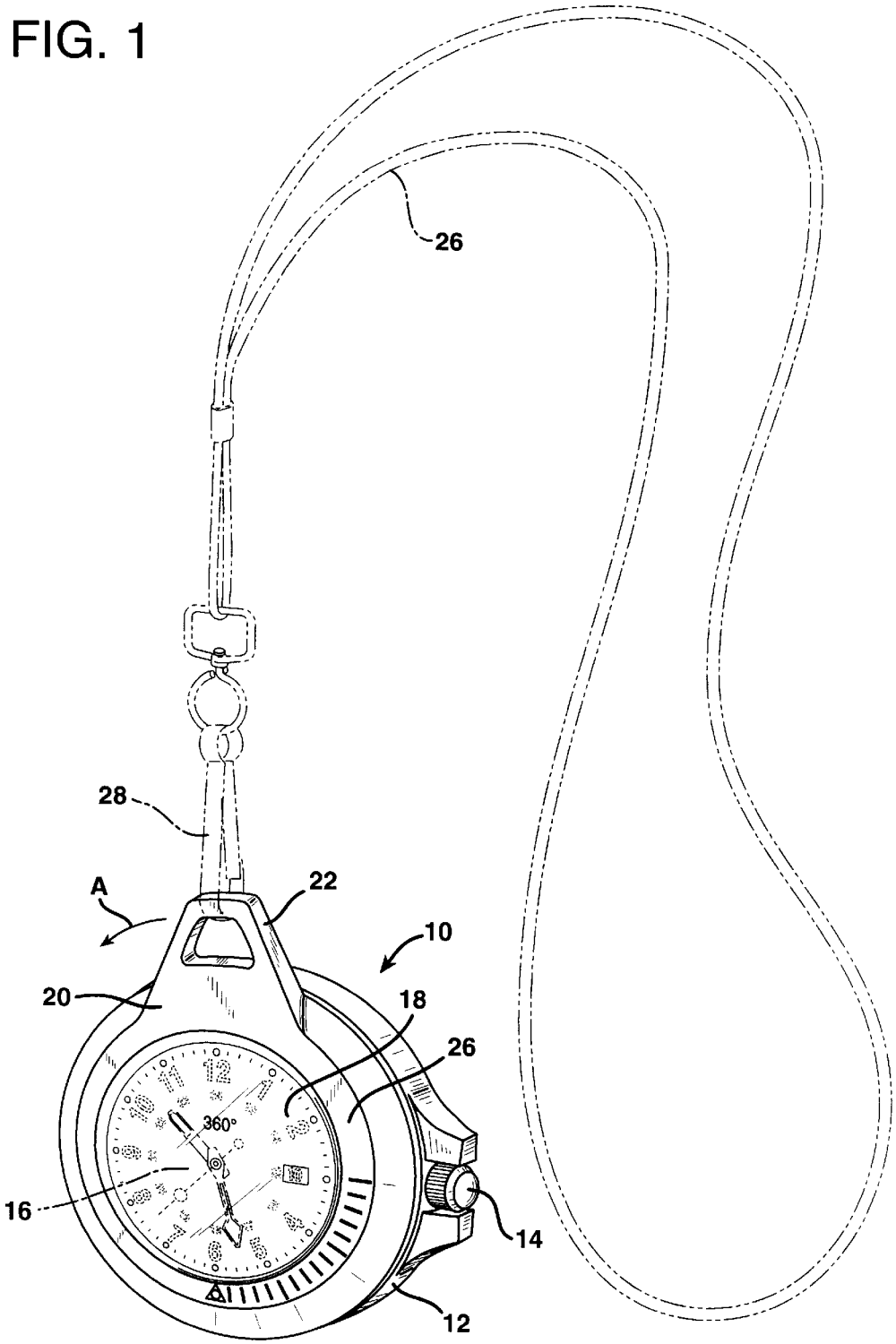

As illustrated in FIG. 1, a watch 10 of the present invention includes a casing 12 preferably formed of an impact resistant and durable material such as stainless steel which has the workings of the watch secured in a water resistant manner therein.

Preferably th e crown includes a screw-down cap 14 for setting and winding the watch. The screw-down cap enhances the shock resistance and water resistance of the stem leading to the interior workings of the watch.

The watch face 16 is viewable through the clear facing or crystal 18, as is well understood. The facing 18 is held to the casing 12 of the watch; and a bezel 20 having an integral fob 22 is secured rotatably to the casing 12.

In a preferred form of the present invention, the bezel has markings 24 which can be rotated so as to position one of the markings, such as the marking indicated 26, at a particular minute on the face 16 of the watch. In this way, the user can securely note elapsed time by noting the markings 24 on the bezel in the event it is necessary for any particular outdoor activity.

As shown in phantom line is a lanyard 26 connected to a hook 28 which can be connected to the fob 22 for securing the watch. With the lanyard 26, the watch can be held around the neck of the user; alternatively other attachment means such as a clip can be provided to connect the fob directly to the belt, pack of the user by a mini carabiner or the like.

Because the bezel 20 connected integrally to the fob 22 is held rotatably to the casing 12; the face of the watch can be rotated when secured to the user into a desired position regardless of the orientation of the user.

In preferred form of the present invention, the bezel 20 is secured to the casing 12 by a ratchet mechanism so that the bezel can be rotated in one direction only; illustrated as the counterclockwise direction by the arrow A FIG. 1.

The above descriptions of a preferred embodiment are not considered limiting to the scope of the invention; and the scope of my invention is set forth below in the claims.

I claim:

1. A watch adapted for use in outdoor activities including a casing holding the workings of the watch including a watch face, a clear facing for viewing the watch face held to the case, and means including a bezel held rotatably to the casing and carrying a integral fob for securing the watch to the user so that the watch casing may be rotated by the user to orient the watch face for viewing.

2. A watch as set forth in claim 1, said bezel being rotatable in one direction only.

3. A watch as set forth in claim 2, said direction being counterclockwise.

4. A watch as set forth in claim 3, said bezel including markings adapted to the position at a selected minute indicated on the watch face or representing elapsed time from the position of said marking.

5. A watch as set forth in claim 2, said bezel including markings adapted to the position at a selected minute indicated on the watch face or representing elapsed time from the position of said marking.

6. A watch as set forth in claim 1, said bezel including markings adapted to the position at a selected minute indicated on the watch face or representing elapsed time from the position of said marking.

* * * * *